United States Patent [19]

Plumadore

[11] 3,991,311

[45] Nov. 9, 1976

[54] CHARGING MASK FOR ELECTROPHOTOGRAPHY

[75] Inventor: John D. Plumadore, Westfield, Mass.

[73] Assignee: Scott Paper Company, Philadelphia, Pa.

[22] Filed: Apr. 23, 1975

[21] Appl. No.: 570,880

[52] U.S. Cl. ..... 250/326; 250/315 R; 317/262 A

[51] Int. Cl.[2] ..... G03G 13/00; G03G 15/00; H01T 19/04

[58] Field of Search..... 250/324, 326, 325, 315 R; 317/262 A

[56] References Cited

UNITED STATES PATENTS

| | | | |
|---|---|---|---|
| 3,438,053 | 4/1969 | Howell | 250/315 R |
| 3,603,851 | 9/1971 | Metcalf et al. | 250/325 |
| 3,688,107 | 8/1972 | Schneider et al. | 250/324 |

OTHER PUBLICATIONS

Terman; F. E., Radio Engineers' Handbook, First Edition, McGraw-Hill, New York and London, 1943, p. 602.

*Primary Examiner*—Alfred E. Smith
*Assistant Examiner*—T. N. Grigsby
*Attorney, Agent, or Firm*—R. Duke Vickrey; John W. Kane, Jr.

[57] ABSTRACT

Disclosed is an improved apparatus for applying a uniform electrostatic charge to a predetermined portion of an electrophotographic film. The apparatus includes a corona generation source and a mask framing the predetermined portion of the film. The improvement consists of an electrically conductive surface surrounding the frame opening of the mask and spaced from the surface of the film and a capacitor interconnecting the electrically conductive surface with ground. The electrically conductive surface on the mask develops a voltage close to that of the surface potential of the film during corona charging so that very little charge field discontinuity exists between the mask and the film, thereby permitting uniform electrostatic charging of the film up to the edges of the portion being charged.

6 Claims, 2 Drawing Figures

CHARGING MASK FOR ELECTROPHOTOGRAPHY

BACKGROUND OF THE INVENTION

1. Field of the Invention

This invention relates generally to electrophotography, and more particularly, to an improvement in charging a predetermined portion of an electrophotographic element in a manner which creates uniform charge up to the edges of the predetermined portion.

2. Description of the Prior Art

In electrophotography, it is common to apply a uniform electrostatic charge to the surface of a recording element or film which generally consists of a photoconductive layer overlying a conductive layer. The charge is then selectively dissipated in a pattern by exposing the surface to a light image. The resulting pattern of charges produces an electrostatic latent image on the photoconductive layer which is rendered visible by applying thereto electrostatically charged developer particles which adhere to the surface of the photoconductive layer by electrostatic forces. A permanent visible image can be obtained, for example, by using developer particles which can be heat fused to the photoconductive layer, and subjecting it to a heat application step.

Charging is conventionally accomplished by exposing the surface of the photoconductive layer to a corona discharge, the polarity of which is chosen to produce the desired results upon the particular photoconductive layer being charged. Superior image reproductions are obtainable only when very uniform electrostatic charges are established on the photoconductive layer before imaging.

In many electrophotographic apparatus, either the corona generating element or the electrophotographic recording element is moved during charging, which to some extent improves uniformity of charge over the surface of the photoconductive layer. In some electrophotographic apparatus, charging takes place with no relative movement between the corona generating element and the electrophotographic recording element. In such cases, the recording element may be a multiframe microfiche and charging is commonly restricted to a small area on the electrophotographic member by some form of shielding or masking means. This form of charging is accomplished without relative movement between the microfiche and the charging means, and it conventionally results in a generally uniform potential of several hundred volts across most of the surface being charged and a potential of zero volts at the borders of the area being charged. Unfortunately, the portion of the surface having uniformm charge does not extend up to the borders. Rather, the amount of charge tapers down to zero volts over some finite distance as the borders are approached. After imaging and developing the charged area, this border area has undesirable edge toning because of the charge gradient occurring there. Where the imaging step dissipates the entire charge at the border region, edge toning is not such a problem, but in conventional apparatus, the charge in the border region is seldom entirely dissipated.

In view of the shortcomings of the prior art, it is an object of the present invention to apply a uniform electrostatic charge to a predetermined portion of an electrophotographic film in a manner which produces uniform charge up to the edges of the portion being charged.

SUMMARY OF THE INVENTION

The invention provides uniform charging even in the border regions of a predetermined portion of an electrophotographic film by use of an electrically conductive surface surrounding the frame opening of the mask which frames the portion of the film being charged. The electrically conductive surface is spaced from the surface of the film and is interconnected by a capacitor to ground. When the predetermined portion of the electrophotographic film is subjected to corona charging, the electrically conductive surface of the mask charges to a voltage close to the surface potential of the electrophotographic member. Since the electrically conductive surface and the charged portion of the film are essentially at the same charge potential at all times during the charge cycle, little field discontinuity exists between the mask and the film and undesirable edge toning is avoided.

DESCRIPTION OF THE PREFERRED EMBODIMENT OF THE INVENTION

While the present invention has beneficial application for corona charging a variety of electrophotographic elements in a variety of apparatus, it will be described herein in its preferred use of charging a predetermined portion or frame of a multi-frame microfiche, which is imaged in the same location in which it is charged. The microfiche can be one upon which a number of documents are recorded in separate, distinct frames of a small size, such as 11¾ × 16½ millimeters. It should be recognized, however, that for purposes of describing and claiming the invention, the term "film" is used to mean any electrophotographic recording element.

Figure 1:
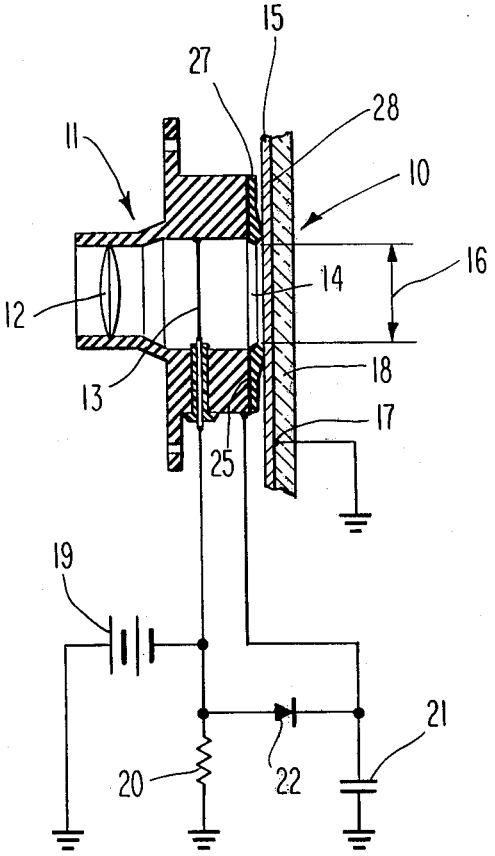
FIG. 1 is a cross-sectional view schematically illustrating corona generating means in operative position against an electrophotograhic recording member.

Referring to FIG. 1, a portion of a conventional electrophotographic film or microfiche 10 is illustrated and consists of support 18 coated with a very thin conductive layer 28, which in turn is coated with a photoconductive layer 15. The support 18 is preferably electrically insulating and may comprise any of the well-known materials used for such purposes. Any conventional conductive materials may be employed to render conductive layer 28 electrically conductive, such as a plated metallic or other conductive layer coated onto support 18. Similarly, any conventional photoconductive material may be used to form photoconductive layer 15.

Microfiche 10 is preferably grounded through a connection 17 at the conductive layer 28. Grounding may be accomplished by any of a number of well-known techniques, such as removing a portion of the photoconductive layer 15 or the insulating support 18 to permit the grounding connection 17 to contact the conductive layer 28. Before imaging, the microfiche 10 is positioned against charging and imaging module 11 to place a frame of microfiche 10 on the optical axis of the imaging system. Within the module 11 are lens 12 and corona discharge electrode 13. Opposite the lens 12, the lens module 11 has a rectangular opening 14 against which the photoconductive layer 15 is placed for charging and imaging. The opening 14 is framed by a mask which prevents charging beyond the frame (represented by 16 in one of the two dimensions) placed against the opening 14.

One lead from a conventional high voltage power source 19 is connected to conventional corona electrode 13 and is grounded through a resistor 20. The opposite lead of power source 19 is grounded. The power source 19 could be of any conventional type. By way of example only, it could be provided by a potential in the range of from 6½ to about 9 kilovolts DC with the negative lead connected to corona electrode 13.

Figure 2:
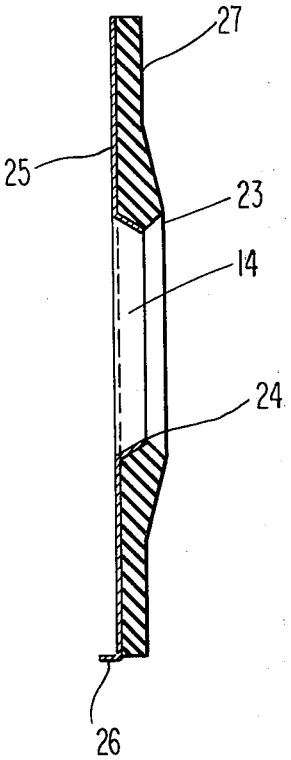
FIG. 2 is an enlarged view of the mask which is part of the means illustrated in FIG. 1.

The front of module 11 is formed by mask means 27 which has a rectangular opening 14 against which the frame 16 of microfiche 10 to be charged and imaged is placed. Mask means 27, like the remainder of module 11, is made from nonconducting material, such as nylon. On the inner surface of the mask means 27 is an electrically conductive surface 25 (referring to FIG. 2). The electrically conductive surface 25 extends to the interior edges 24 of the opening 14, but is spaced away from frame-engaging borders 23 of mask means 27 to assure that electrically conductive surface 25 does not contact photoconductive surface 15 of microfiche 10. Thus, frame-engaging borders 23 should be constructed of nonconducting material. It is preferable that frame-engaging borders 23 are spaced outwardly slightly from the interior edges 24 of electrically conductive surface 25, as illustrated in FIG. 2, to assure that electrically conductive surface 25 extends to the very border of the microfiche frame 16 being charged.

Electrically conductive surface 25 is interconnected through an external connection 26 to a capacitor 21 (FIG. 1), which interconnects electrically conductive surface 25 to ground. A back-biased diode 22 can be used to automatically discharge capacitor 21 upon termination of charging corona electrode 13 from power source 19. However, other conventional switch means could also be used to discharge capacitor 21, as long as conductive surface 25 is discharged prior to charging the next microfiche frame.

The material used to form electrically conductive surface 25 can be provided by a thin metallic sheet, such as brass or copper, or by painting conductive lacquer upon the nonconducting frame material. A satisfactory conductivity has been found to be one having a surface resistivity of from about $10^4$ to about $10^5$ ohms per square centimeter. Greater conductivity is satisfactory, and lesser conductivity might be satisfactory in some cases. A test for determining whether the conductivity is satisfactory is to connect the conductive surface 25 directly to ground during corona charging. If the conductivity is adequate, the conductive surface will not build up a charge potential to a similar extent as the charge potential built up by photoconductor 15.

The size of external capacitor 21 preferred can be determined by the formula $C_1 = C_F \times A_M \div A_F$, wherein $C_1$ is the desired capacitance 21 connecting electrically conductive surface 25 to ground; $C_F$ is the capacitance of the portion of the film being charged (a single frame of a microfiche, for example); $A_M$ is the effective area of the conductive surface 25 subject to corona charging (which is usually the actual area in the small charge modules in which the invention is preferably used, but could be something less than the total area where the area of the conductive surface is so large that it is not all charged by the corona source); and $A_F$ is the area of the frame being charged. $C_F$ is usually equal to the capacitance of the frame being charged if the film is grounded, as illustrated in FIG. 1, but if the film is connected to ground through an external capacitor, $C_F$ will be the combination of the frame capacitance and the film external capacitance. While the size of external capacitor 21 for conductive surface 25 is preferably chosen in accordance with the foregoing formula, it can be appreciated that some variation from the calculated value can be tolerated with satisfactory although less than optimum results. However, it is believed that the value of the external capacitor 21 should not be varied much beyond 4 or 5 times greater than or from ¼ to 1/5 as great as the value determined by the formula.

While the invention has been described in its preferred use of charging a small frame of a multi-frame microfiche (a use for which it is particularly advantageous), it should be recognized that it is useful for charging larger portions of a film, or even the entire film. Therefore, the term "predetermined portion" as used in the specification and claims means an entire film, as well as a portion of an entire film.

I claim:

1. In an apparatus for applying a uniform electrostatic charge to a predetermined portion of an electrophotographic film, comprising a corona source and a mask for stationarily positioning against the film during charging to frame the predetermined portion, the improvement to the mask comprising:

an electrically conductive surface surrounding the frame opening of the mask and spaced from the surface of the film; and a capacitor interconnecting the electrically conductive surface with ground so that very little charge field discontinuity exists between the mask and the film.

2. Apparatus as described in claim 1, wherein the capacitor has a value approximately equal to the capacitance of the portion of the film being charged times the effective area of the conductive surface exposed to the corona source divided by the area of the portion of the film being charged.

3. Apparatus as described in claim 2, further including means for shortcircuiting the capacitor, whereby the charge stored in the capacitor during corona charging can be discharged prior to charging the next portion of the film.

4. Apparatus as described in claim 1, wherein the mask is made from a nonconductive material and a portion of the nonconductive material forms frame-engaging borders and is positioned against the film to frame the portion of the film being charged.

5. Apparatus as described in claim 4, wherein the electrically conductive surface extends inwardly slightly beyond the frame-engaging borders.

6. Apparatus as described in claim 2, wherein the film is a multi-frame microfiche and the predetermined portion charged is one frame.

* * * * *